US008065984B2

(12) United States Patent
Issler et al.

(10) Patent No.: US 8,065,984 B2
(45) Date of Patent: Nov. 29, 2011

(54) PISTON FOR INTERNAL COMBUSTION ENGINE

(75) Inventors: Wolfgang Issler, Schwaikheim (DE); Timo Estrum, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 566 days.

(21) Appl. No.: 12/225,208

(22) PCT Filed: Mar. 23, 2007

(86) PCT No.: PCT/DE2007/000532

§ 371 (c)(1),
(2), (4) Date: Sep. 16, 2008

(87) PCT Pub. No.: WO2007/110056

PCT Pub. Date: Oct. 4, 2007

(65) Prior Publication Data

US 2009/0288618 A1 Nov. 26, 2009

(30) Foreign Application Priority Data

Mar. 25, 2006 (DE) ..... 10 2006 013 884

(51) Int. Cl.
*F02F 3/00* (2006.01)

(52) U.S. Cl. ..... 123/193.1

(58) Field of Classification Search ..... 123/193.6, 123/193.1

See application file for complete search history.

(56) References Cited

U.S. PATENT DOCUMENTS

| | | | |
|---|---|---|---|
| 2,386,117 | A | 10/1945 | Hvid |
| 2,991,769 | A | 7/1961 | Chapin |
| 4,375,782 | A | 3/1983 | Schieber |
| 6,659,062 | B1 | 12/2003 | Issler |
| 7,051,684 | B2 | 5/2006 | Bauer |

FOREIGN PATENT DOCUMENTS

| | | | |
|---|---|---|---|
| DE | 395 659 | * | 5/1924 |
| DE | 1 476 393 | | 4/1969 |
| DE | 37 07 462 | | 7/1991 |
| DE | 40 18 252 | | 12/1991 |
| DE | 100 28 926 | | 12/2001 |
| DE | 102 14 830 | | 1/2004 |
| DE | 103 46 822 | * | 4/2005 |

(Continued)

OTHER PUBLICATIONS

International Search Report.

*Primary Examiner* — Michael Cuff
*Assistant Examiner* — James Kim
(74) *Attorney, Agent, or Firm* — Collard & Roe, P.C.

(57) ABSTRACT

The invention relates to a piston (10, 110, 210, 310, 410) for an internal combustion engine, comprising a piston head (11) with at least one piston crown (12) which is exposed to at least one jet of combustion gases, and a piston shaft (17), the piston head (11) and the piston shaft (12) being configured as interconnected individual components including a peripheral outer cooling channel (27). The invention is characterized in that an annular partition wall (35, 135, 235, 335, 435) is provided in the cooling channel (27) in parallel to the piston crown (12) and has one or more nozzle-type openings (37, 45, 137, 237, 337, 437) that are arranged in such a manner that their respective outlet jet is directed against the underside (12*a*) of the piston crown (12).

9 Claims, 3 Drawing Sheets

FOREIGN PATENT DOCUMENTS

Figure 1:
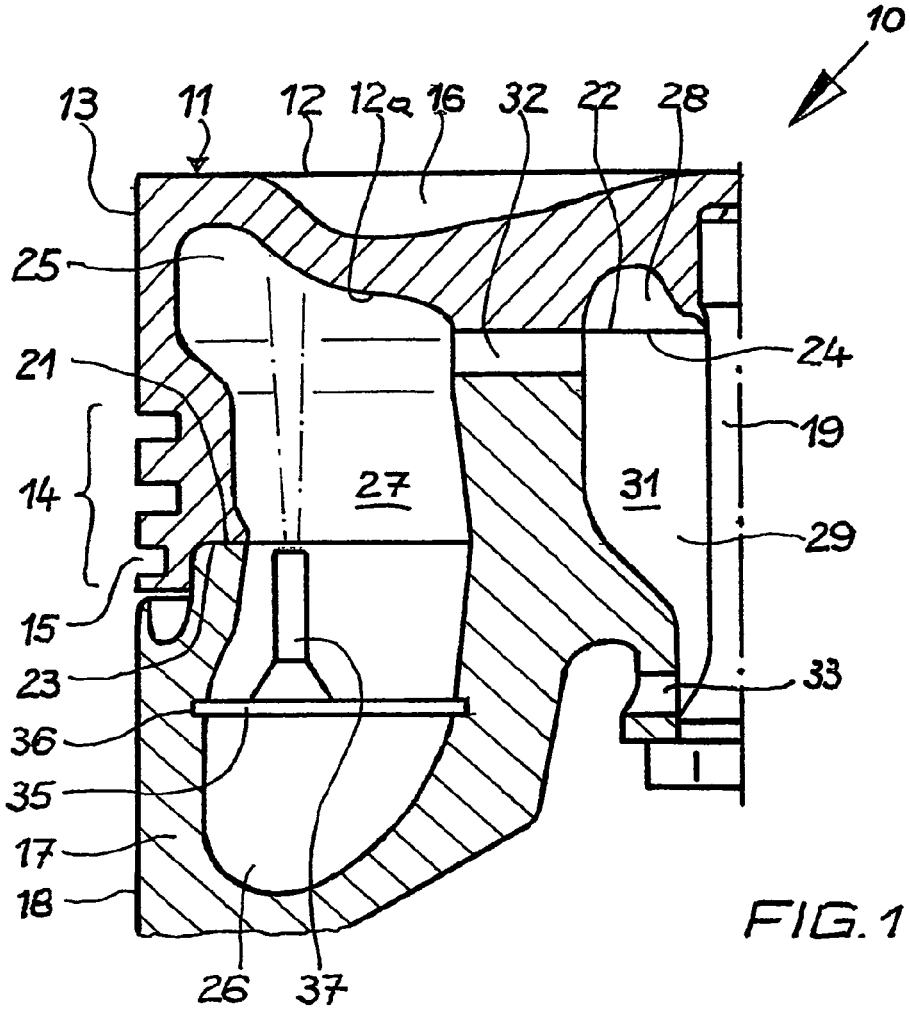

| | | | |
|---|---|---|---|
| DE | 10 2004 038 465 | | 2/2006 |
| EP | 0 439 995 | | 8/1991 |
| EP | 0 747 591 | | 12/1996 |
| EP | 1 185 774 | | 3/2002 |
| EP | 1 199 461 | | 4/2002 |
| FR | 1 099 734 | * | 4/1954 |
| FR | 1 169 381 | * | 3/1957 |
| GB | 05690 | | 8/1915 |
| GB | 348 084 | | 10/1929 |
| GB | 769 919 | | 3/1957 |
| GB | 840 145 | | 7/1960 |
| GB | 1 089 255 | | 11/1967 |
| GB | 1 262 794 | | 2/1972 |
| JP | 62-041919 | | 2/1987 |

* cited by examiner

PISTON FOR INTERNAL COMBUSTION ENGINE

CROSS REFERENCE TO RELATED APPLICATIONS

This application is the National Stage of PCT/DE2007/000532 filed on Mar. 23, 2007, which claims priority under 35 U.S.C. §119 of German Application No. 10 2006 013 884.8 filed on Mar. 25, 2006. The international application under PCT article 21(2) was not published in English.

The present invention relates to a piston for an internal combustion engine, comprising a piston head having a piston crown exposed to at least one combustion jet, and a piston skirt having pin bores for accommodating a piston pin, whereby the piston head and the piston skirt are configured as individual components connected with one another, which enclose a circumferential outer cooling channel.

As part of the combustion chamber, the piston crown is directly impacted by the hot combustion gases, in the form of combustion jets, and this leads to local temperature peaks. In order to reduce the stresses on the piston crown that result from the uneven temperature distribution, it is known to cool the piston crown, in that cooling oil is guided in the direction of the underside of the piston crown. In this connection, an attempt is made to reinforce the cooling effect by means of the so-called "shaker effect." It is known from DE 40 18 252 C1 to dispose a ring-shaped guide body in the outer cooling channel, for this purpose, which body guides the cooling oil that flows into the cooling channel towards the underside of the piston crown. EP 1 185 774 B1 describes a piston having a cooling channel that is open towards the piston skirt, is closed off with a ring-shaped wall part having a complex structure, and has crosswise walls that extend axially into the cooling channel, which guide the cooling oil into the cooling channel, taking advantage of the shaker effect. DE 102 14 830 A1 also discloses a piston having a cooling channel that is open towards the piston skirt, which channel is closed off with a cover that has an oil inlet.

The task of the present invention consists in making available a piston for an internal combustion engine in which the cooling effect of the cooling oil passed to the cooling channel is further improved.

The solution consists in a piston having the characteristics of claim 1. According to the invention, it is provided that a ring-shaped partition wall disposed parallel to the piston crown is provided in the cooling channel, which wall has one or more nozzle-like openings that are disposed in such a manner that their exit jet, in each instance, is directed at the underside of the piston crown.

The configuration according to the invention makes it possible, for the first time, to guide the cooling oil onto the underside of the piston crown, in targeted manner. As a result, one is no longer dependent solely on the shaker effect for wetting the underside of the piston crown with cooling oil. In the case of the configuration according to the invention, the shaker effect is helpful for ejecting the cooling oil from the at least one nozzle-like opening at a certain speed, ideally a high speed. The direction of the cooling oil jet is then determined by the configuration and/or the placement of the nozzle-like opening. The underside of the piston crown is now intensively impacted with cooling oil. The cooling oil that flows off is again subject to the conventional shaker effect, before it flows out of the outer cooling channel, in known manner, for example through passage openings that lead to a center cooling chamber.

Advantageous further developments are evident from the dependent claims.

In the case of a particularly preferred further development, the cooling oil jet(s) that exit(s) from the nozzle-like openings are directed at those regions of the underside of the piston crown that lie opposite the region(s) of the piston crown that are exposed to the at least one combustion jet. In this way, it is possible, for the first time, to reduce the temperature peaks that occur on the piston crown, in targeted manner, and to reduce the risk of premature material fatigue.

The partition wall can be disposed in the region of the cooling channel formed by the piston skirt, for example. The space situated below the partition wall therefore has a relatively slight volume, so that comparatively little cooling oil is required to achieve a good cooling effect. In this connection, it is particularly advantageous if the space situated below the partition wall is completely filled with cooling oil, so that a particularly high cooling pressure is applied at the at least one nozzle-like opening, and the cooling oil jet experiences optimal acceleration when it is ejected from the opening.

In an alternative configuration, the piston head has an inner and an outer contact surface, and the piston skirt has an inner and an outer support surface, corresponding to these, in each instance. Because of this configuration, the partition wall can be disposed between the inner or outer contact surface and the support surface assigned to it, so that it is particularly easy to install and to attach.

The partition wall can be disposed, on the one hand, between an inner contact surface and the support surface assigned to it. Then, it is advantageous if a ring-shaped gap is provided between the outer circumference surface, i.e. the outer edge region of the partition wall, and the outer wall of the cooling channel, through which the cooling oil can flow back into the region below the partition wall.

On the other hand, however, the partition wall can also be disposed between an outer contact surface and the support surface assigned to it. Then, it is advantageous if a ring-shaped gap is provided between the inner circumference surface, i.e. the inner edge region of the partition wall, and the inner wall of the cooling channel, through which the cooling oil can flow back into the region below the partition wall.

In the case of a cast piston, in particular, the partition wall can also be configured as a wall part integrated into the piston head or into the piston skirt, which is cast in during production of the piston.

The at least one nozzle-shaped opening is configured as a bore disposed in the partition wall, or in the wall part, respectively, in a simple and practical embodiment. A particularly efficient cooling effect is achieved if the at least one nozzle-shaped opening is configured as a nozzle body. Such a nozzle body can be configured in one piece with the partition wall or the wall part, but it can also be configured as a separate component and attached to the partition wall or the wall part. In a particularly effective embodiment, the nozzle body is configured as a Venturi jet, so that the pressure and speed of the cooling oil can be controlled in targeted manner.

In addition to the at least one nozzle-shaped opening, at least one flow-through opening can be provided in the partition wall or the wall part, respectively, through which the cooling oil flows back into the region below the partition wall or the wall part, respectively.

Figure 2:
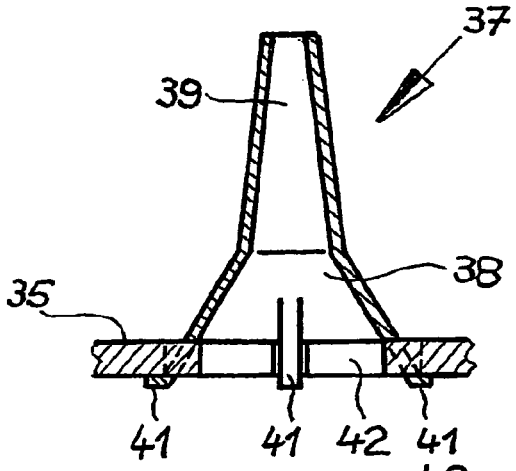
Figure 3:
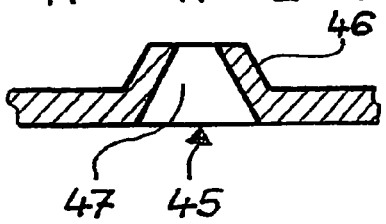
Figure 5:
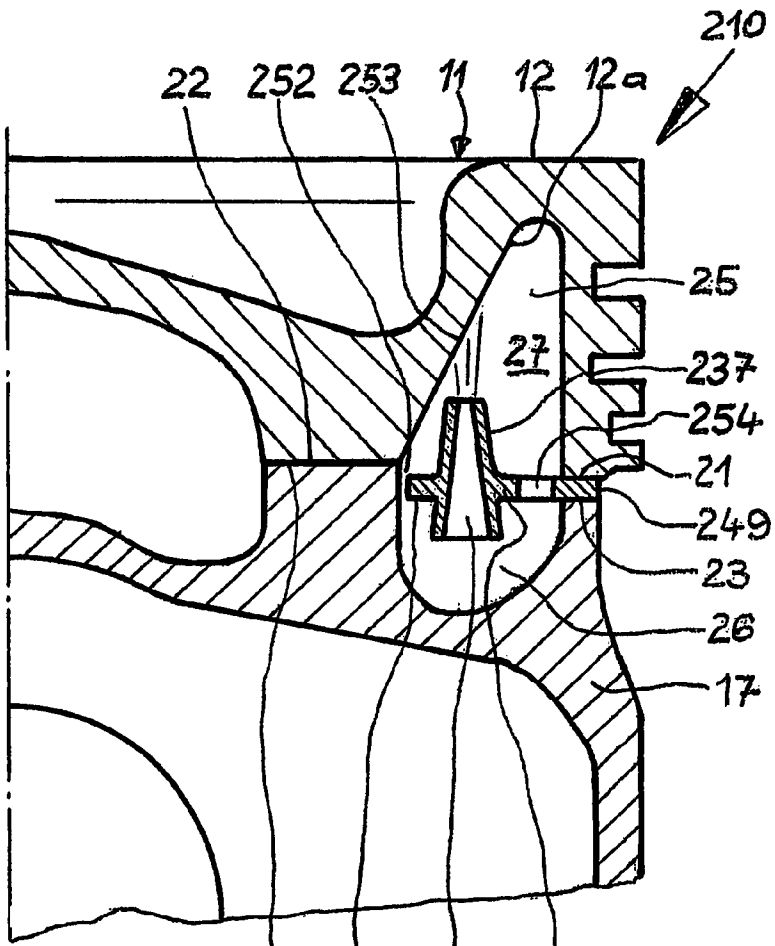
Figure 4:
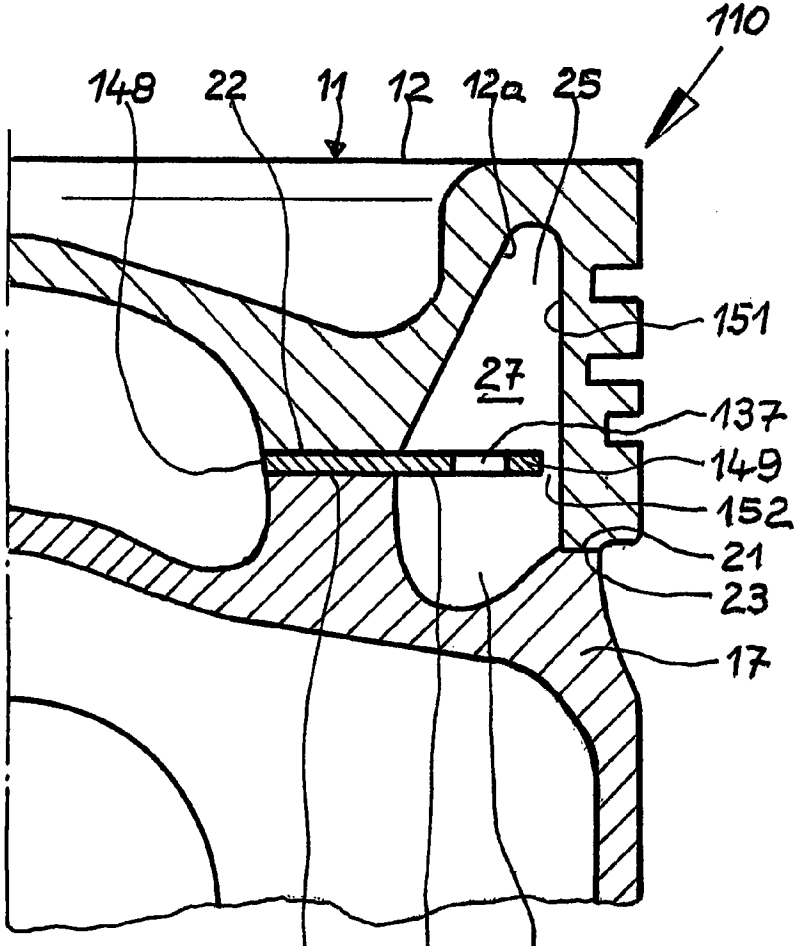
Figure 7:
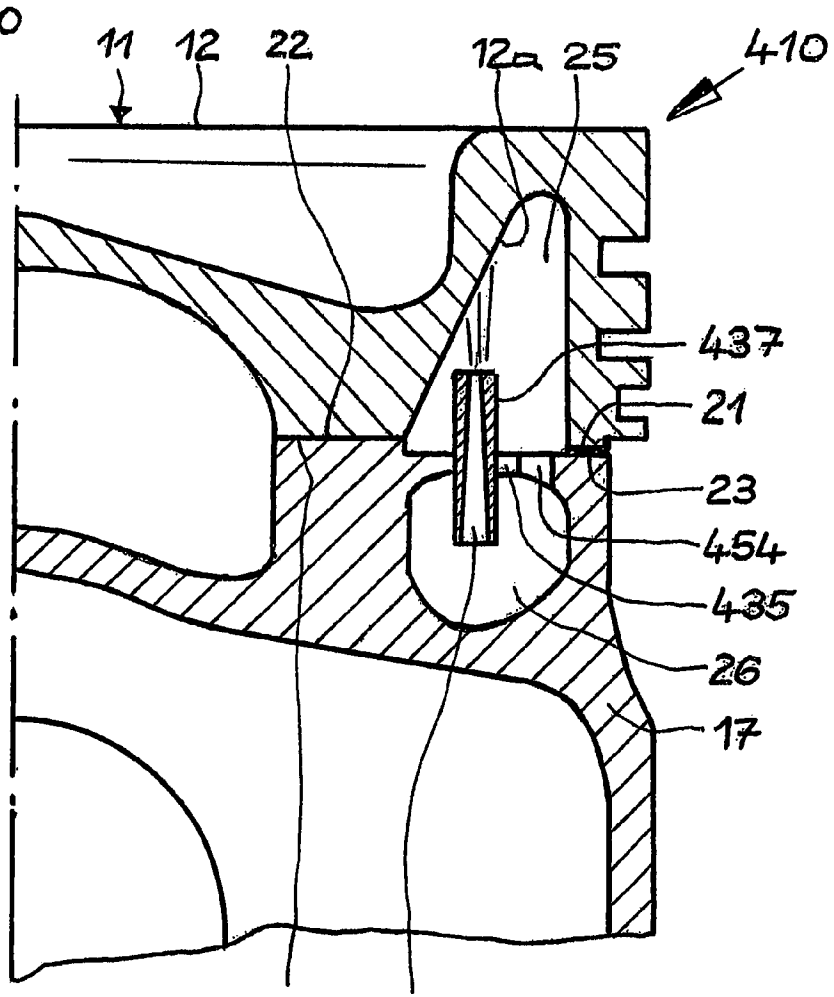
Figure 6:
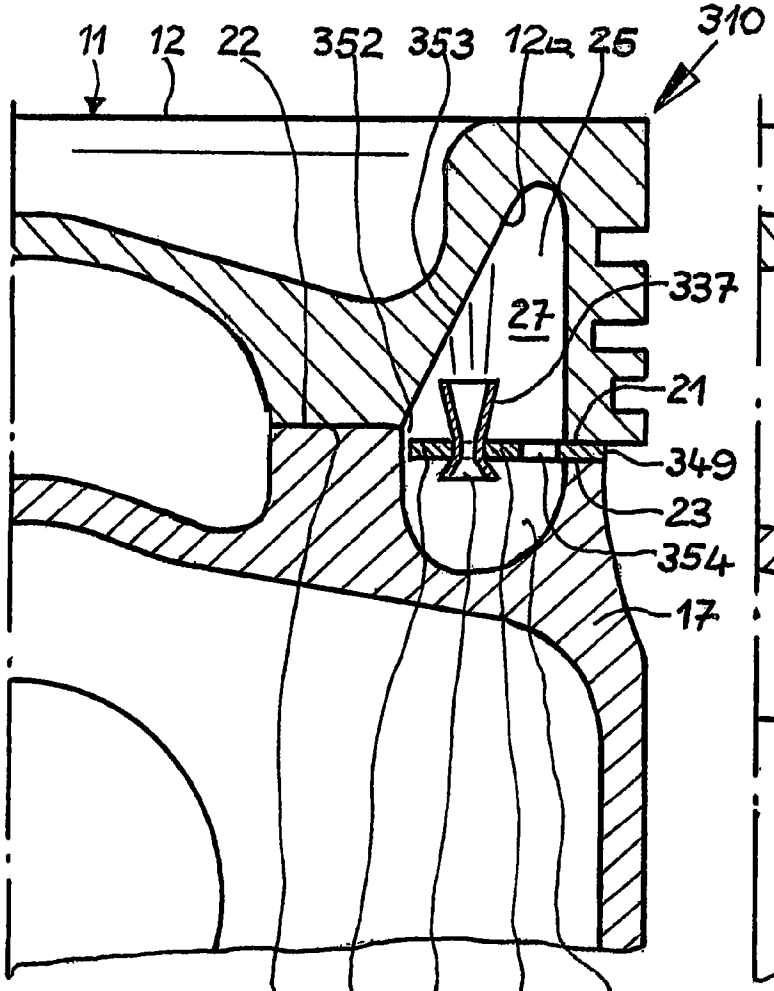

Exemplary embodiments of the invention will be described in greater-detail in the following, using the attached drawings. These show, in a schematic representation, not to scale:

FIG. 1 a first exemplary embodiment of a piston according to the invention, in section;

FIG. 2 a first embodiment of a nozzle body, in section;

FIG. 3 a first embodiment of a nozzle-like opening, in section;

FIG. 4 another exemplary embodiment of a piston according to the invention, in section;

FIG. 5 another exemplary embodiment of a piston according to the invention, in section;

FIG. 6 another exemplary embodiment of a piston according to the invention, in section;

FIG. 7 another exemplary embodiment of a piston according to the invention, in section.

FIG. 1 shows a first exemplary embodiment of a composite piston 10. The piston 10 has a piston head 11 having a piston crown 12, a circumferential top land 13, and a circumferential ring belt 14 with ring grooves 15 for accommodating piston rings, not shown. The piston crown 12 is provided with a combustion bowl 16. The piston 10 furthermore has a piston skirt 17 having a working surface 18. Other components of the piston skirt 17, such as pin bosses, pin bores, etc., are not shown, for reasons of a clearer illustration.

Generally, the piston head 11 consists of a particularly temperature-resistant metallic material, while the piston skirt 17 preferably consists of a light-metal material, cast iron, or of a steel material. The piston head 11 and the piston skirt 17 are connected with one another in known manner, as is usual for composite pistons. In the exemplary embodiment, the piston head 11 and the piston skirt 17 are braced to one another by means of a central screw connection 19.

On its side facing the piston skirt 17, the piston head 11 has an outer circumferential contact surface 21 and an inner circumferential contact surface 22. Accordingly, the piston skirt 17 has a corresponding outer circumferential support surface 23 and an inner circumferential support surface 24 on its side facing the piston head 11. In the assembled state, the contact surfaces 21, 22 of the piston head rest on the support surfaces 23, 24 of the piston skirt 17.

In the piston head 11, a circumferential recess 25 is formed in at about the level of the top land 13 and the ring belt 14, while a corresponding ring-shaped recess 26 is formed into the surface of the piston skirt 17 that faces the piston head 11. In the assembled state, the recesses 25, 26 form an outer circumferential cooling channel 27, whereby the underside 12*a* of the piston crown 12 forms the upper end of the cooling channel 27. The piston head 11 furthermore has a central recess 28 on its surface that faces the piston skirt 17, and the piston skirt has a corresponding central recess 29 on its surface that faces the piston head 11. In the assembled state, the two recesses 28, 29 form a cooling chamber 31. The cooling channel 27 and the cooling chamber 31 are connected with one another by means of at least one passage opening 32 disposed in the region of the inner support surface 24 of the piston skirt 17. The cooling chamber 31 is open towards the piston pin by way of another passage opening 33.

A ring-shaped partition wall 35 made of a metallic material, for example of a sheet steel or sheet spring steel, is disposed in the recess 26 formed into the piston skirt 17, forming the lower part of the outer cooling channel 27, and runs parallel to the piston crown 12. The partition wall 35 is held in grooves 36, which are made in the side walls of the recess 26, under bias. Nozzle-like openings in the form of nozzle bodies 37 are disposed on the partition wall 35, all around. Furthermore, the partition wall 135 can have beads provided for reinforcement.

In operation, the recess 26 below the partition wall 35 is completely filled with cooling oil, forced in by way of the connecting rod and piston pin, which oil is therefore not subject to the "shaker effect" caused by the piston movement. As a result of the pressure that occurs in the recess 26, the cooling oil therefore ideally continuously exits from the nozzle body 37, at high pressure, by way of a crank angle movement of 360°, but particularly during the downward movement of the piston, and is sprayed against the underside 12*a* of the piston crown 12 in the form of a sharp jet. Depending on the shape and the orientation of the nozzle body 37, the exiting jets of cooling oil can be guided, in targeted manner, onto regions of the underside 12*a* that lie opposite regions of great thermal stress of the piston crown 12 that result from impacting combustion jets.

FIG. 2 shows a first exemplary embodiment of a nozzle-like opening in the form of a nozzle body 37, as it can be used, for example, in a piston according to FIG. 1. The nozzle body 37 is configured as a separate component, and can consist of metal or a suitable plastic, for example. The nozzle body 37 has a funnel-shaped inlet region 38 for the cooling oil, which narrows in the direction of the underside 12*a* of the piston crown 12. The inlet region 38 is followed by a nozzle head 39 directed towards the underside 12*a* of the piston crown 12. The circumferential free edge of the inlet region 38 has elastic tongues 41, which are clipped into corresponding openings of the partition wall 35 above a passage opening 42 for the cooling oil that is made in the partition wall 35.

FIG. 3 shows another exemplary embodiment of a nozzle-like opening 45, made in one piece with the partition wall 35. In the exemplary embodiment, the nozzle-like opening 45 is an elevation 46 in the shape of a truncated cone in cross-section, which surrounds a passage opening 47 for the cooling oil that narrows in the direction of the underside 12*a* of the piston crown 12.

FIG. 4 shows another exemplary embodiment of a piston 110 according to the invention, whereby the same components are provided with the same reference numbers as those used in FIG. 1. A ring-shaped partition wall 135 made of a metallic material, for example a sheet steel or a sheet spring steel, is disposed in the outer cooling channel 27, and runs parallel to the piston crown 12. The ring-shaped partition wall 135 is held and clamped between the inner contact surface 22 of the piston head 11 and the inner support surface 24 of the piston skirt 17 with its inner circumferential edge region 148. The outer circumferential edge region 149 of the partition wall 135 projects freely into the cooling channel 27, so that a ring-shaped gap 152 is formed between it and the outer wall 151 of the cooling channel 27, which is situated approximately at the level of the top land 13 and of the ring belt 14. Nozzle-like openings in the form of bores 137 are disposed on the partition wall 135, all around. The partition wall 135 can have beads provided for reinforcement.

In operation, the recess 26 below the partition wall 135 is filled with cooling oil, forced in by way of the connecting rod and piston pin. As a result of the ring-shaped gap 152 according to FIG. 4, an oil pressure that is less than the pressure according to the exemplary embodiment according to FIG. 1 occurs in the recess 26. The cooling oil that is accelerated in the direction of the piston crown 12, starting from a crank angle of 270°, therefore exits from the bores 137 at a lower pressure, but still in the form of sharp jets, so that in this way, a cooling effect is achieved, which exceeds the one achieved by means of the shaker effect. This is particularly achieved by means of corresponding dimensioning of the oil volume in the recess 26, the gap width of the gap 152, and the pressure of the oil forced into the recess 26 by way of the connecting rod and piston pin.

Depending on the arrangement of the bores 137, the exiting jets of cooling oil can be guided, in targeted manner, onto regions of the underside 12*a* that lie opposite regions of great thermal stress of the piston crown 12 that result from impacting combustion jets.

FIG. 5 shows another exemplary embodiment of a piston 210 according to the invention, whereby the same components are provided with the same reference numbers as those used in FIG. 1. A ring-shaped partition wall 235 made of a metallic material, for example a sheet steel or a sheet spring steel, is disposed in the outer cooling channel 27, and runs parallel to the piston crown 12. The ring-shaped partition wall 235 is held and clamped between the outer contact surface 21 of the piston head 11 and the outer support surface 23 of the piston skirt 17 with its outer circumferential edge region 249. The inner circumferential edge region 248 of the partition wall 235 projects freely into the cooling channel 27, so that a ring-shaped gap 252 is formed between it and the inner wall 253 of the cooling channel 27, which is formed by the recess 25. Nozzle-like openings in the form of nozzle bodies 237 are disposed on the partition wall 235, all around. The nozzle bodies 237 are configured in approximately conical shape, in cross-section, and surround a passage opening 247 for the cooling oil that narrows towards the underside 12*a* of the piston crown 12. Adjacent to the nozzle bodies 237, flow-through openings 254 for cooling oil that flows back into the recess 26 are configured in the partition wall 235.

In operation, the recess 26 below the partition wall 235 is filled with cooling oil, forced in by way of the connecting rod and piston pin. Analogous to the explanation relating to the exemplary embodiment according to FIG. 4, controlled cooling of the piston crown 12 takes place here, according to the same principle, using the passage openings 247 of the nozzle bodies 237. The cooling oil exits from the passage openings 247 of the nozzle bodies 237 under pressure, in accordance with the crank angle position, and is sprayed against the underside 12*a* of the piston crown 12 in the form of a sharp jet. Depending on the arrangement and orientation of the nozzle bodies 237, the exiting jets of cooling oil can be guided, in targeted manner, onto regions of the underside 12*a* that lie opposite regions of great thermal stress of the piston crown 12 that result from impacting combustion jets. The cooling oil flows back into the recess 26 through the flow-through openings 254.

FIG. 6 shows another exemplary embodiment of a piston 310 according to the invention, whereby the same components are provided with the same reference numbers as those used in FIG. 1. A ring-shaped partition wall 335 made of a metallic material, for example a sheet steel or a sheet spring steel, is disposed in the outer cooling channel 27, and runs parallel to the piston crown 12. The ring-shaped partition wall 335 is held and clamped between the outer contact surface 21 of the piston head 11 and the outer support surface 23 of the piston skirt 17 with its outer circumferential edge region 349. The inner circumferential edge region 348 of the partition wall 335 projects freely into the cooling channel 27, so that a ring-shaped gap 352 is formed between it and the inner wall 353 of the cooling channel 27 formed by the recess 25. Nozzle-like openings in the form of nozzle bodies 337 are disposed on the partition wall 335, all around. In this exemplary embodiment, the nozzle bodies 337 are configured as separate components and integrated into the partition wall 335. In this exemplary embodiment, the nozzle bodies 337 are configured as Venturi jets, and surround a passage opening 347 for the cooling oil. Flow-through openings 354 for cooling oil that flows back into the recess 26 are formed adjacent to the nozzle bodies 337, in the partition wall 335.

In operation, the recess 26 below the partition wall 335 is filled with cooling oil, forced in by way of the connecting rod and piston pin. Analogous to the explanation relating to the exemplary embodiment according to FIG. 4, controlled cooling of the piston crown 12 takes place here, according to the same principle, using the passage openings 347 of the nozzle bodies 337. The cooling oil exits from the passage openings 347 of the nozzle bodies 337 under pressure, in accordance with the crank angle position, and is sprayed against the underside 12*a* of the piston crown 12 in the form of a sharp jet. Depending on the arrangement and orientation of the nozzle bodies 337, the exiting jets of cooling oil can be guided, in targeted manner, onto regions of the underside 12*a* that lie opposite regions of great thermal stress of the piston crown 12 that result from impacting combustion jets. The cooling oil flows back into the recess 26 through the flow-through openings 354, or to the inner cooling chamber, by way of overflow channels.

FIG. 7 shows another exemplary embodiment of a piston 410 according to the invention, whereby the same components are provided with the same reference numbers as those used in FIG. 1. In this exemplary embodiment, the piston skirt 17 is produced from spheroidal iron. A partition wall configured as a ring-shaped wall part 435 is disposed in the outer cooling channel 27, and runs parallel to the piston crown 12; this wall separates the recess 26 in the piston skirt 17 from the recess 25 in the piston head 11. The wall part 435 is cast in one piece with the piston skirt 17. Of course, instead, the piston head 11 can also be a cast part, and can have a wall part cast in one piece with the piston head 11. Nozzle-like openings in the form of nozzle bodies 437 are disposed on the wall region 435, all around. In this exemplary embodiment, the nozzle bodies 437 are configured as separate components and integrated into the wall part 435. The nozzle bodies 437 can be screwed in, glued in, pressed in, or attached in some other way. In this exemplary embodiment, they have an approximately cylindrical outer contour. They surround a passage opening 447 for the cooling oil that narrows towards the underside 12*a* of the piston crown 12, and connects the recesses 25 and 26 with one another. Flow-through openings 454 for cooling oil that flows back into the recess 26 are configured in the wall part 435, adjacent to the nozzle bodies 437.

In operation, the recess 26 below the wall part 435 is filled with cooling oil, forced in by way of the connecting rod and piston pin. Analogous to the explanation relating to the exemplary embodiment according to FIG. 4, controlled cooling of the piston crown 12 takes place here, according to the same principle, using the passage openings 447 of the nozzle bodies 437. The cooling oil exits from the passage openings 447 of the nozzle bodies 437 under pressure, in accordance with the crank angle position, and is sprayed against the underside 12*a* of the piston crown 12 in the form of a sharp jet. Depending on the arrangement and orientation of the nozzle bodies 437, the exiting jets of cooling oil can be guided, in targeted manner, onto regions of the underside 12*a* that lie opposite regions of great thermal stress of the piston crown 12 that result from impacting combustion jets. The cooling oil flows back into the recess 26 through the flow-through openings 454, or to the inner cooling chamber, by way of overflow channels.

The invention claimed is:

1. A piston for an internal combustion engine, comprising:

a piston head having a piston crown exposed to at least one combustion jet; and a piston skirt, the piston head and the piston skirt being configured as individual components connected with one another and enclosing a circumferential outer cooling channel, wherein a ring-shaped partition wall disposed parallel to the piston crown is provided in the cooling channel, said wall having at least one nozzle shaped body that is configured as a Venturi jet and is disposed in such a manner that an exit jet is directed at an underside of the piston crown.

2. The piston according to claim 1, wherein the at least one exit jet is oriented towards a region of the underside of the piston crown that lies opposite the region of the piston crown that is exposed to at least one combustion jet.

3. The piston according to claim 1, wherein the partition wall is disposed in a region of the cooling channel formed by the piston skirt.

4. The piston according to claim 1, wherein the piston head has an outer and an inner contact surface, and the piston skirt has an outer and an inner support surface corresponding to the outer and inner contact surface, respectively, and wherein the partition wall is disposed between the outer contact surface and the outer support surface, or between the inner contact surface and inner support surface.

5. The piston according to claim 4, wherein the partition wall is disposed between the inner contact surface and the inner support surface, and wherein a ring-shaped gap is provided between an outer edge region of the partition wall and an outer wall of the cooling channel.

6. The piston according to claim 4, wherein the partition wall is disposed between the outer contact surface and the outer support surface, and wherein a ring-shaped gap is provided between an inner edge region of the partition wall and an inner wall of the cooling channel.

7. The piston according to claim 1, wherein the partition wall is configured as a wall part integrated into the piston head or into the piston skirt.

8. The piston according to claim 1, wherein the nozzle body is configured as a separate component, and attached to the partition wall.

9. The piston according to claim 1, wherein in addition to the at least one nozzle-shaped opening, at least one flow-through opening is provided in the partition wall.

* * * * *